US006862813B1

(12) United States Patent
Chen et al.

(10) Patent No.: US 6,862,813 B1
(45) Date of Patent: Mar. 8, 2005

(54) LASER ARCHERY BOW SIGHT

(76) Inventors: Chung T. Chen, 340 Dewpoint La., Alpharetta, GA (US) 30022; Keith Oliver, 65 Rocky Cir., Cartersville, GA (US) 30184

( * ) Notice: Subject to any disclaimer, the term of this patent is extended or adjusted under 35 U.S.C. 154(b) by 0 days.

(21) Appl. No.: 10/078,714

(22) Filed: Feb. 19, 2002

(51) Int. Cl.[7] ..... F41G 1/00
(52) U.S. Cl. ..... 33/265; 33/263; 33/87
(58) Field of Search ..... 33/265, 263, 87; 124/87

(56) References Cited

U.S. PATENT DOCUMENTS

| | | | | | |
|---|---|---|---|---|---|
| 2,669,023 | A | * | 2/1954 | Pizzuti | 33/265 |
| 2,925,656 | A | * | 2/1960 | Genovese | 33/265 |
| 3,641,675 | A | * | 2/1972 | Funk, Jr. | 33/265 |
| 4,179,613 | A | * | 12/1979 | Koren | 33/265 |
| 4,329,972 | A | * | 5/1982 | Wilson | 33/265 |
| 4,753,528 | A | * | 6/1988 | Hines et al. | 33/265 |
| 4,974,576 | A | * | 12/1990 | Morey et al. | 124/87 |
| 5,161,310 | A | * | 11/1992 | Stoot | 33/265 |
| 5,419,050 | A | * | 5/1995 | Moore | 124/87 |
| 5,435,293 | A | * | 7/1995 | Grimaldi | 124/87 |
| 5,495,675 | A | * | 3/1996 | Huang | 124/87 |
| 5,782,002 | A | * | 7/1998 | Reed | 33/265 |
| 5,992,403 | A | * | 11/1999 | Slates | 124/89 |
| 6,042,245 | A | * | 3/2000 | Stanley | 124/87 |
| 6,134,793 | A | * | 10/2000 | Sauers | 33/265 |
| 6,430,821 | B1 | * | 8/2002 | Cionni | 33/265 |
| 6,477,779 | B1 | * | 11/2002 | Slates | 33/265 |
| 6,526,666 | B1 | * | 3/2003 | Lastinger, Jr. | 33/265 |

* cited by examiner

*Primary Examiner*—Diego Gutierrez
*Assistant Examiner*—Yaritza Guadalupe
(74) *Attorney, Agent, or Firm*—Baker Donelson

(57) ABSTRACT

An archery laser bow sight (10) for a bow (11) having a forwardly extending stabilizing bar (17) is provided having a laser (22) and a mounting system (21) for mounting the laser (22) to the stabilizing bar (17). The mounting system (21) has a laser carrier (25), a top clamping bracket (26) and two lower clamping brackets (27) which fixedly capture the bow stabilizing bar (16) therebetween.

9 Claims, 2 Drawing Sheets

LASER ARCHERY BOW SIGHT

TECHNICAL FIELD

This invention relates to laser sights, and (specifically to laser sights used with an archery bow.

BACKGROUND OF THE INVENTION

Laser sights have been utilized for many years in connection with firearms, such as rifles and pistols. These laser sights are typically mounted to either the trigger guard or to the barrel of the firearm, as shown in U.S. Pat. Nos. 5,758,448, 4,152,754, 4,212,109 and 4,168,588. Today's firearms easily accept such laser sights as they are typically manufactured with a mounting bar or ridge upon the barrel to which a sighting devices such as a laser sight or telescopic sight is mounted.

Devising a sighting device for archery bows however have proven to be difficult. Archery bows typically utilize "pin sights" to aid the archer in aiming the bow. Such pin sights include a slotted mounting plate coupled to the handle of the bow and a series of pins mounted to the mounting plate for movement along the slots. The archer moves each pin vertically along the slot in order to sight in each particular pin sight for a select distance to the target. Once the pin sights are set, the archer visually aligns the pin sight, for that specific distance to the target, with the target when shooting an arrow. These pin sights however are not very accurate as the depend largely upon the position of the archer's head during sighting and as they do not provide adequate horizontal alignment of the target.

In an effort to provide more accurate bow sights developers have mounted lasers to bows which direct a beam of light to a target. These laser bow sights have typically been mounted to the handle portion of the bow, as shown in U.S. Pat. Nos. 4,606,629 and 5,495,675. The handle mounted laser bow sights however are difficult to mount as the configuration of each bow handle differs between bow manufacturers. As such, the laser sight oftentimes moves or slides and therefore becomes misaligned during use. Furthermore, the mounting of these sights upon the handle oftentimes scratches or scars the handle. Lastly, the laser sight is mounted upon a portion of the bow that flexes somewhat during use, thereby further exasperating the previously recited problems of providing a stable mounting platform for the sighting device.

Accordingly, it is seen that a need remains for a laser bow sight which overcomes problems associated with that of the prior art. It is to the provision of such therefore that the present invention is primarily directed.

SUMMARY OF THE INVENTION

In a preferred form of the invention, an archery bow sight adapted for use with an archery bow having a handle and two oppositely disposed limbs comprises a bow stabilizing bar extending forwardly from the handle, a laser, and a mounting bracket for mounting the laser to the stabilizing bar so as to direct a laser beam forwardly from the bow. With this construction, the laser is mounted to the stabilizing bar so as to direct a laser beam in a direction generally along a portion of the path of an arrow propelled by the bow.

DETAILED DESCRIPTION

Figure 1:
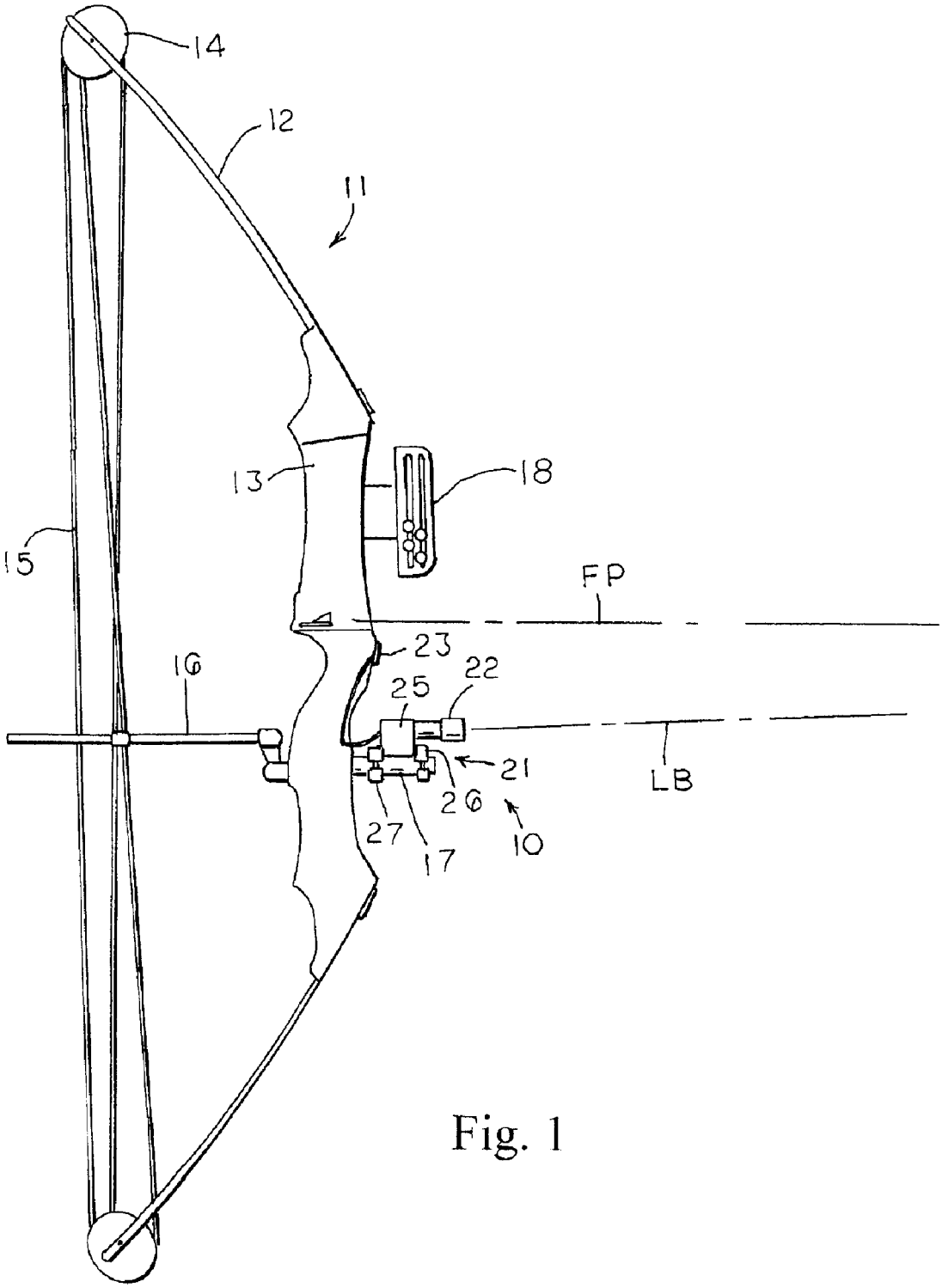
FIG. 1 is a side view of the laser bow sight embodying principles of the invention in a preferred form, shown mounted to an archery bow.
Figure 2:
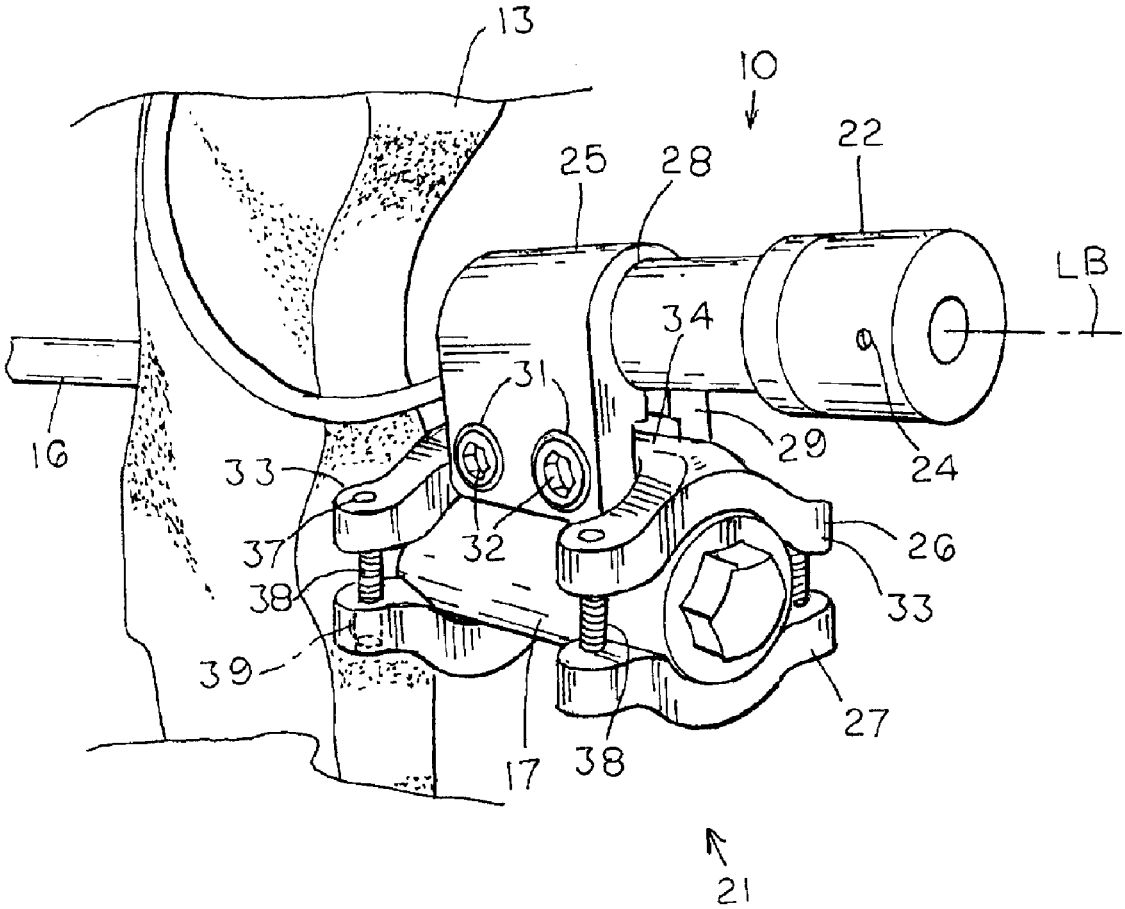
FIG. 2 is a perspective view of the laser bow sight and a portion of the archery bow of FIG. 1.

With reference next to the drawings, there is shown a laser bow sight 10 in a preferred form of the invention. The bow sight 10 is shown mounted to a conventional compound bow 11 which typically includes a pair of flexible limbs 12 extending from opposite ends of a handle 13. The compound bow also has a rigging system including mechanical advantage varying structures, commonly referred to as eccentrics or cams 14; and cables 15 which transfer a multiple of a bowstring tension to the respective limbs. Cables 15 are sometimes referred to as tension runs, cable stretches, bow string end stretches and end stretches. The compound bow has a rearwardly extending cable guide post 16 and a forwardly extending stabilizing bar 17. Lastly, the bow has a conventional pin sight 18.

The laser bow sight 10 includes a mounting system 21 and a cylindrical laser 22. The laser 22 has a conventional visible light laser diode and lens, an internal battery, and a remote on/off switch 23 mounted to the handle 13. The visible light laser 23 may be a model number LM 650 Series made by Amstech Incorporated of Alpharetta, Ga., which includes four peripherally mounted adjustment screws 24 which adjust the alignment of the laser diode and lens through threaded movement of the adjustment screws 24.

The mounting system 21 has a laser carrier 25, a top clamping bracket 26 and two lower clamping brackets 27. The laser carrier 25 has a laser mounting hole 28 therein sized and shaped to receive the laser 22, two downwardly depending legs 29, and four set screw mounting holes 31 extending through the legs 29 each of which is sized and shaped to receive a set screw 32. The top clamping bracket 26 has two oppositely disposed yokes 33 and a carrier mounting bar 34 extending between the two yokes 33. The carrier mounting bar 34 has four unshown threaded set screw holes aligned with the set screw mounting holes 31 of the carrier 25, each of which is sized and shaped to threadably receive a set screw 32. Each yoke 33 also has two oppositely disposed threaded screw mounting holes 37 adapted to threadably receive a mounting screw 38 passing through holes 39 within the lower clamping brackets 27 so as to fixedly capture the bow stabilizing bar 16 therebetween.

In use, the top clamping bracket 26 and two lower clamping brackets 27 are positioned on opposite sides of the bow stabilizing bar 17 and the mounting screws 38 are tightened so as to fix the relative positions of the brackets upon the stabilizing bar 17. With the laser 22 positioned within the laser mounting hole 28 the carrier the legs 29 are positioned on opposite sides of the top clamping bracket mounting bar 34. The relative position of the laser carrier 25 upon the top clamping bracket 26 and the relative position of the laser 22 within the laser carrier 25 is fixed by passing the four set screws 32 through the carrier leg set screw holes 31 and threading them into the top clamping bracket set screw holes. The switch 23 is then mounted to the handle 13 through adhesive or other suitable means.

To vertically sight the laser the archer aims the bow at a target a select distance through the use of the pin sights 18. The position of the laser diode and lens is then adjusted through the threaded movement of the adjustment screws 24 until the laser points to the same location indicated by the pin sight 18. Obviously, one could vertically sight in the laser sight without the use of the pin sight 18 through a series of trial and error shots with the bow. The archer then adjusts the laser horizontally by similar process. To ensure that the bow is properly sighted the archer fires several arrows and adjust the laser accordingly if the laser is found to be misaligned. As such, the laser beam LB from the laser is aligned generally along a portion of the flight path FP of an arrow for a select distance, of course, the flight path of the arrow is effected by gravity and thus slightly curved while the light beam path is straight.

Once the laser 22 is properly sighted the archer may utilize the laser bow sight 10 by drawing the cable 15 backwards with an arrow coupled thereto. The archer then depresses and maintaining the depressed position of the switch 23 so as to energize the laser diode through the current from the laser battery. The archer then places the laser or light beam produced by the laser 22 upon a target and releases the arrow through the release of the cable.

It should be understood that the mounting of the bow sight to the stabilizer bar enables a generally uniformly shaped platform to which the sight is mounted, as opposed to the prior art devices which were mounted to the bow handle which may be of different shapes and sizes. Furthermore, the stabilization bar provides a platform which does not bend during the use of the bow which may result in the misalignment of the sight, another problem associate with bow sights mounted to the bow handle.

It should be understood that alternatively the laser 22 may be provided with an on/off switch mounted directly or remotely to the laser which energizes and de-energizes the laser with each actuation of the switch, i.e. the laser is energized with the first depression of the switch and subsequently de-energized with the second actuation of the switch. Also, it should be understood that the just described bow sight may be utilized with any type of bow so long as it includes a forwardly extending stabilizing bar.

It thus is seen that a laser bow sight is now provided which overcomes problems with those of the prior art. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. An archery bow sight adapted for use with an archery bow having a handle and two oppositely disposed limbs, the bow sight comprising:

a bow stabilizing bar extending forwardly from the handle;

a laser; and a mounting bracket assembly mounting said laser to said stabilizing bar so as to direct a laser beam forwardly from the bow, said mounting bracket assembly includes a first mounting bracket adapted to conform to one side of said stabilizing bar, at least a second bracket adapted to conform to another side of said stabilizing bar opposite said one side, and coupling means for coupling said first bracket and said second bracket together while capturing said stabilizing bar therebetween;

whereby the laser is mounted to the stabilizing bar so as to direct a laser beam in a direction generally along a portion of the path of an arrow propelled by the bow.

2. The archery bow sight of claim 1 wherein said laser includes a laser actuation switch mounted to the handle of the bow.

3. The archery bow sight of claim 1 wherein said laser includes adjustment means for adjusting the direction of the laser light beam produced by said laser.

4. An archery bow sight adapted to be mounted to an archery bow having a stabilizing bar, the bow sight comprising:

a laser;

a mounting bracket assembly mounting said laser to said stabilizing bar so as to direct a laser beam forwardly from the bow, said mounting bracket assembly includes a first mounting bracket adapted to conform to one side of said stabilizing bar, at least a second bracket adapted to conform to another side of said stabilizing bar opposite said one side, and coupling means for coupling said first bracket and said second bracket together while capturing said stabilizing bar therebetween, and whereby the laser is mounted to the stabilizing bar so as to direct a laser beam in a direction generally along a portion of the path of an arrow propelled by the bow.

5. The archery bow sight of claim 4 wherein said laser includes a laser actuation switch mounted to the handle of the bow.

6. The archery bow sight of claim 4 wherein said laser includes adjustment means for adjusting the direction of the laser light beam produced by said laser.

7. An archery bow sight adapted to be mounted to an archery bow having a stabilizing bar, the bow sight comprising:

a laser;

a mounting means for mounting said laser to said stabilizing bar so as to direct a laser beam forwardly from the bow, said mounting means includes a first mounting bracket adapted to conform to one side of said stabilizing bar, at least a second bracket adapted to conform to another side of said stabilizing bar opposite said one side, and coupling means for coupling said first bracket and said second bracket together while capturing said stabilizing bar therebetween; and whereby the laser is mounted to the stabilizing bar so as to direct a laser beam in a direction generally along a portion of the path of an arrow propelled by the bow.

8. The archery bow sight of claim 7 wherein said laser includes a laser actuation switch mounted to the handle of the bow.

9. The archery bow sight of claim 7 wherein said laser includes adjustment means for adjusting the direction of the laser light beam produced by said laser.

* * * * *